US008348809B2

(12) United States Patent
van der Zande et al.

(10) Patent No.: US 8,348,809 B2
(45) Date of Patent: Jan. 8, 2013

(54) SYSTEM FOR TRAINING OPTIMISATION

(75) Inventors: Marc Esse van der Zande, 'S-Hertogenbosch (NL); Johannes van der Loo, Boskoop (NL); Sytze Kalisvaart, Eindhoven (NL)

(73) Assignee: Nederlandse organisatie voor toegepast-natuurwetenschappelijk onderzoek TNO, Delft (NL)

( * ) Notice: Subject to any disclaimer, the term of this patent is extended or adjusted under 35 U.S.C. 154(b) by 814 days.

(21) Appl. No.: 12/440,201

(22) PCT Filed: Sep. 4, 2007

(86) PCT No.: PCT/NL2007/050432

§ 371 (c)(1), (2), (4) Date: Jul. 15, 2009

(87) PCT Pub. No.: WO2008/030091

PCT Pub. Date: Mar. 13, 2008

(65) Prior Publication Data

US 2010/0076278 A1 Mar. 25, 2010

(30) Foreign Application Priority Data

Sep. 6, 2006 (EP) ..... 06076684

(51) Int. Cl.
*A63B 71/00* (2006.01)

(52) U.S. Cl. ..... 482/8; 482/9; 482/901; 434/247; 600/300

(58) Field of Classification Search ..... 482/1–9, 482/900–902; 434/247; 600/300
See application file for complete search history.

(56) References Cited

U.S. PATENT DOCUMENTS

| | | | | |
|---|---|---|---|---|
| 7,278,966 | B2 * | 10/2007 | Hjelt et al. | 600/300 |
| 2003/0224337 | A1 | 12/2003 | Shum et al. | |
| 2005/0171410 | A1 | 8/2005 | Hjelt et al. | |
| 2006/0025282 | A1 | 2/2006 | Redmann | |

FOREIGN PATENT DOCUMENTS

| | | | |
|---|---|---|---|
| EP | 1 101 511 | A2 | 5/2001 |
| EP | 1 159 898 | A | 12/2001 |

(Continued)

OTHER PUBLICATIONS

International Search Report for PCT/NL2007/050432 dated Dec. 12, 2007.

(Continued)

*Primary Examiner* — Glenn Richman
(74) *Attorney, Agent, or Firm* — Leydig, Voit & Mayer, Ltd.

(57) ABSTRACT

System for training optimisation, the system comprising: at least one sensor for measuring a mechanical load parameter which is indicative for a mechanical load of the training a storage module for storing data which are dispatched by the least one sensor in a log file; a training advice module which is arranged for determining a personal training advice related to a load assessment of the user based on at least the data stored in the log file, the data comprising a cumulative load parameter or a training load history determined on the basis of historical sensor data stored in the log file, the training advice comprising the frequency of next training sessions and/or a type of training to be performed in the next training session; at least one output device such as a display, a sound signal, audio output, voice output or a vibrating element for outputting said training advice to said user.

17 Claims, 5 Drawing Sheets

FOREIGN PATENT DOCUMENTS

| | | |
|---|---|---|
| WO | WO 01/87426 A | 11/2001 |
| WO | WO 02/00111 A1 | 1/2002 |

OTHER PUBLICATIONS

Londeree et al. "Influence of Age and Other Factors on Maximal Heart Rate:" J. Cardiac Rehab 1984:4:44-49.
Morree et al. "Inspanningsfysiologie, oefentherapie en training". Bohn Stafleu van Loghum, Houten, 2006, Chapter 4: Hartfunctie, circulatie en inspanning, pp. 60-67.
American Journal of Respiratory and Critical Care Medicine; 2003; 167(2):211-277.
Whaley et al. "Predictors of over- and underachievement of age-predictedmaximal heart rate" Official Journal of the American College of Sports Medicine (2006); MSSE 1992;24(10); 1173-1179.

* cited by examiner

SYSTEM FOR TRAINING OPTIMISATION

TECHNICAL FIELD

The invention relates to a system for training optimisation.

The present invention involves a system that monitors and coaches a user in his training activities and adapts its advices and training suggestions based on the measured activities of the user. The term training is to be interpreted broadly in the sense that it not only relates to sport training but also training for revalidation, health, wellness, appearance etc.

BACKGROUND ART

The prior art known to applicant does not describe such a system. The most relevant publication known to applicant is WO02/00111. This publication relates to a system for monitoring heath, wellness and fitness. The known system discloses a sensor device worn on the arm in which a accelerometer, a galvanic skin response sensor and a heat sensor are incorporated and which collects data. Based on these data analytical status data is processed in a central monitoring unit. First, a user has to complete an initial survey on the basis of which a profile is generated that provides the user with a summary of his or her relevant characteristics and life circumstances. A plan and/or set of goals is provided in the form of a suggested healthy daily routine. The suggested healthy daily routine may include any combination of specific suggestions for incorporating proper nutrition, exercise, mind centering, sleep, and selected activities of daily living in the user's life. Subsequently, the known system collects data with the sensor device and based on these data the central monitoring unit presents charts which compare the collected data with the suggested healthy daily routine. In fact, the known system is a monitoring system and does not generate information for optimisation of training.

Other background art is provided by the Foster system for physiological characterisation of training. The Foster system defines a "Training load" (TL) which is established by multiplying the duration (D) of the training with the intensity (I) of the training, i.e.:

$$TL=D*I$$

wherein

D is duration;

I is intensity or RPE.

Foster further defines a "Total training load" (TTL) which is established by the sum of the subsequent training loads.

$$TTL=\Sigma TL$$

Forster defines "Monotony" (M) with the following formula:

$$M=\text{average of TL/standard deviation of TL}$$

Finally Forster defines "Training stress" (TS) with the following formula:

$$TS=TTL*M$$

Karvonen has defined a formula to establish a "target heart rate" (THR).

$$THR=((HRmax-HRrest)\times\%\ Intensity)+HRrest$$

wherein

HRmax is the maximum heart rate of the person

HRrest is the average heart rate at rest

% Intensity is a factor which is indicative for the intensity of the training

Maximum heart rate (HRmax) can be estimated using the well known rule of thumb:

$$HRmax=220-age$$

or variants of this rule which are described in [1], [2], [3], [4]. A great individual variety is known to exist.

HRmax can also be measured under supervision of a doctor under very intensive training circumstances. HRrest can be established by taking the average of several measurements of the heart rate at rest.

Finally, the well known Body-Mass index (BMI) can be used to determine whether body weight allows for intensive training.

$$BMI=weight/(length)^2$$

SUMMARY OF THE INVENTION

The invention provides a system for training optimisation, the system comprising:

- at least one sensor for measuring a mechanical load parameter which is indicative for a mechanical load of the training
- a storage module for storing data which are dispatched by the least one sensor in a log file;
- a training advice module which is arranged for determining a personal training advice related to a load assessment of the user based on at least the data stored in the log file, the data comprising a cumulative load parameter or a training load history determined on the basis of historical sensor data stored in the log file, the training advice comprising the frequency of next training sessions and/or a type of training to be performed in the next training session;
- at least one output device such as a display, a sound signal, audio output, voice output or a vibrating element for outputting said training advice to said user.

With such a system a user can obtain a specific and personal training advice for a next training session. Because use is made of mechanical parameter data stored in the log file, the mechanical load of the previous training sessions can be taken into account when determining the training advice for the next training. The training advice module can be adapted to process historical sensor data stored in the log file and, based thereon, determine a frequency for a series of next training sessions and/or determine the type of training to be performed in the next training session. Consequently, the historical mechanical load pattern can be taken into account. It is known that a major group of injuries is caused by cumulative overload as a consequence of too many training sessions within a certain period of time, too intensive training sessions within a certain period of time, poor running technique, or training under the wrong circumstances or with the wrong equipment (like shoes).

The cumulative load parameter is indicative for the mechanical load history of the training sessions which took place before the training session to be determined. When the cumulative load parameter or mechanical load history is high, the training advice module will schedule a training session with a relatively small mechanical load so that the body of the user will have the opportunity to recover. When, on the other hand, the cumulative load parameter is low, the training advice module will schedule a training session with a relatively high mechanical load so that the body is stimulated to expand its biomechanical loadability using the mechanism of supercompensation.

By measuring a mechanical load parameter, which according to an embodiment of the invention is chosen from the group consisting of number of steps, distance, rate of pronation, maximal pronation, timing, rate of loading, impact peak, active peak, alignment of joints (hip, ankle, knee, foot, elbow, wrist), technique, force, impact, speed, rotation (e.g. tibia during stance), rotational speed (e.g. tibia during stance), leg stiffness, vertical stiffness, torsional stiffness, floor-foot contact time and acceleration, and by storing the data from these measurements in a log file, an objective characterisation can be obtained from the mechanical load of previous training sessions.

"Active peak" is defined by the maximal vertical force during the push-off phase in running. "Technique" is defined by the way in which muscles are activated in time resulting in a certain movement pattern. "Leg stiffness" is defined by the maximal vertical force divided by change in vertical leg length. "Vertical stiffness" is defined by the maximal vertical force divided by the vertical displacement of the centre of mass. "Torsional stiffness" is defined by the change in joint moment divided by the change in joint angle.

According to an embodiment of the invention, the data stored in the log file can also be used for determining a training advice for a current training session.

With such an embodiment, the data stored in the log file can not only be used for determining a training advice for a next training session but additionally be used for adapting the current training session by dispatching a training advice for the current training session.

In a further elaboration of the invention the system comprises at least one sensor for measuring a physiological parameter chosen from the group consisting of heartbeat rate, respiration rate, skin temperature, core body temperature, ventilation (liters/minute of breath), volume of oxygen uptake ($VO_2$), $CO_2$ production ($VCO_2$), respiratory exchange ratio between oxygen and carbon dioxide (RER), and lactate levels, the storage module for storing data also being adapted to store data which are dispatched by the at least one sensor for measuring a physiological parameter.

In still a further embodiment of the invention, the system comprises at least one sensor for measuring a performance parameter chosen from the group consisting of speed, distance, acceleration, height (e.g. of jump, hit), impact (e.g. of hit), precision, reproducibility, gross efficiency, goals, correct passes, successful interventions, successful assists, number of goal shots.

In another further embodiment of the invention, the system comprises at least one sensor for measuring an environmental parameter chosen from the group consisting of environmental temperature, humidity, air pressure, altitude, global position (latitude, longitude), wind speed, wind direction, water temperature, wave speed, wave, direction, wave size, ground/ice/snow temperature, ground/ice/snow density, ground/ice/snow stiffness.

Such stored physiological, performance and/or environmental data can be used as input for the training advice module for determining the training advice for the next training session. When for example the heartbeat rate is monitored during the training sessions, possibly combined with one or more performance parameters, the training advice module can determine whether the load of previous training sessions led to an improvement of the condition of the user and can, based thereon, increase the load, i.e. the cardiovascular load, of a next training session which is advised by the training advice module.

In a further embodiment, the stored physiological, performance and/or environmental data can also be used as input for the training advice module for determining the training advice for a current training session. When a change in e.g. physiological data during a current training session is conformal to change in the stored data and when the change in the stored data from a previous training session is to be prevented, then the training advice module can dispatch a training advice for the current (ongoing) training session.

In a further embodiment, the training advice module, when processing sensor data stored in the log file for determining a training advice, can be adapted to take into account at least one of the following parameters: age, length, weight, gender, training level of the user of the system, subjective training evaluation indicators based on filled in question forms etc.

Such parameters are indicative for the condition of the user and play an important role when the determining a training advice.

The training advice module can be adapted to determine on the basis of the historical sensor data stored in the log file a cumulative load parameter which is used for scheduling a next training session and/or determining frequency of a series of next training sessions and/or for determining the type of training to be performed in the next or a current training session.

In an embodiment of the invention at least one sensor for measuring a mechanical parameter is a sensor for determining acceleration of, for example, hip, ankle or knee, wherein the training advice module is arranged for scheduling a training session to be chosen from at least two of the following categories:

a high impact type, e.g. running on a hard surface, a moderate impact type, e.g. jogging on a soft surface, or a low impact type, e.g. bicycling, walking or swimming.

With such a system, the training advice module can provide the user with a balanced training programme containing a proper mixture of a high impact, moderate impact and low impact sports. Simultaneously, when the heart beat rate is also monitored, the cardiovascular load over the various training sessions will be balanced, which is important to improve the condition of the user without in bringing the user into a danger zone with respect to his cardiovascular condition.

In order to give the user a good picture of the history of this training sessions, the system can comprise a representation module for representing the data in the log file in a graphical manner on a display or a hard copy.

The display and the storage module can be part of an electronic device, the electronic device chosen from the group comprising a computer, a hand held computer, a mobile phone, a watch, an armband, a piece of clothing, a waistband and the like, wherein the sensors are connectable to, or part of the electronic device. In an alternative embodiment, the sensors can be connectable to the electronic device via a wireless connection.

The training advice module can be part from said electronic device. However, in an alternative embodiment, the training advice module can be part from a server at a remote site, wherein the log file in the storage module is transferable to the server via a data network, such as a wireless data network, the internet, a telephone network or combinations thereof.

The invention shall be further elucidated with reference to embodiments shown in the figures.

DETAILED DESCRIPTION OF THE DRAWINGS

Figure 1:
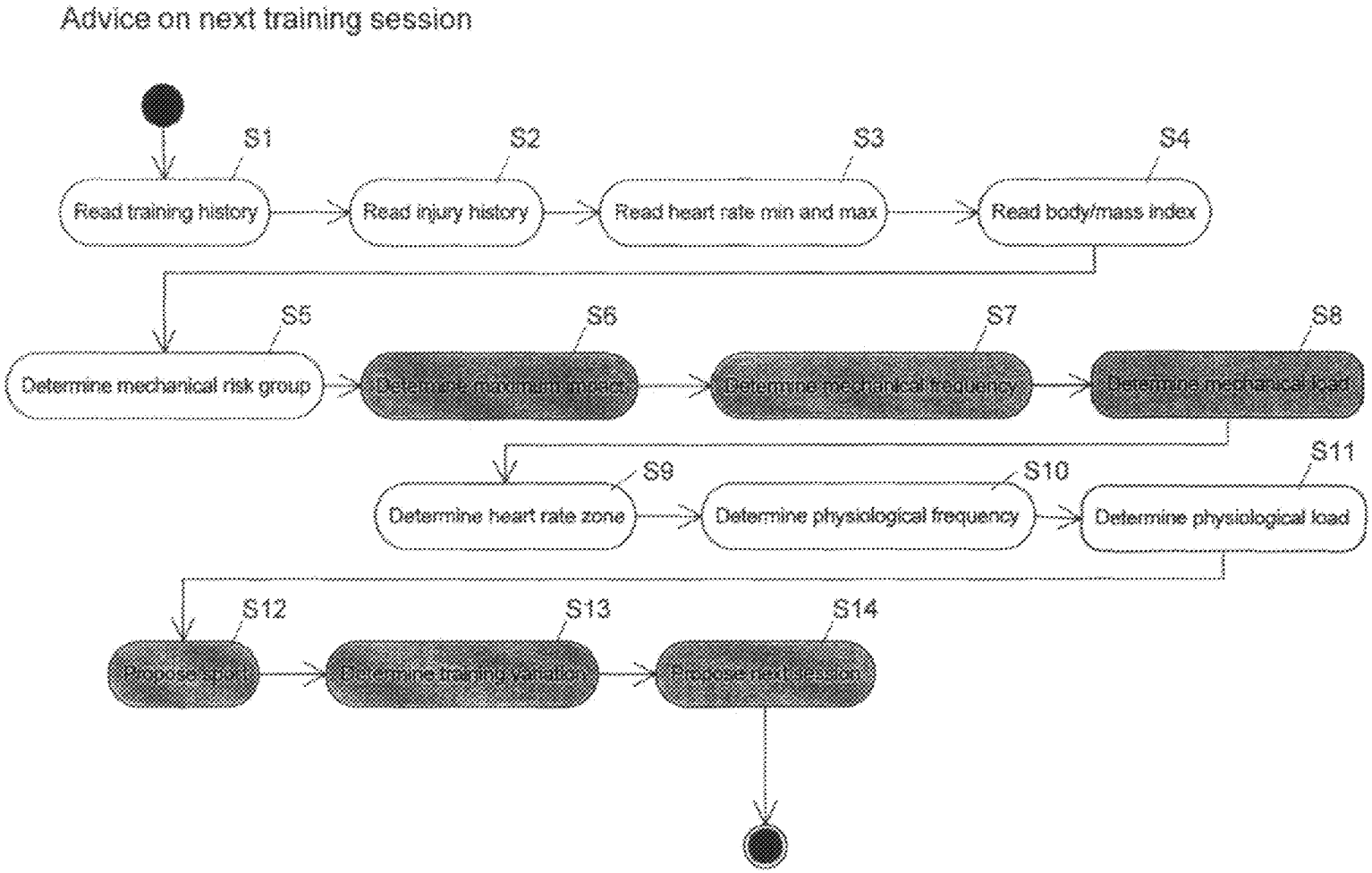
FIG. 1 is a schematic representation of an embodiment for determining an advice on a next training session.

FIG. 1 shows a flow chart for determining and advice on a next training session.

When determining an advice for a next training session, the system in a first step S1 reads a training history. The training history can be known to the system when the user has answered questions at an intake session. Such an intake session can be based on questions which are posed via a user interface of the system. The answers on the questions will provide an indication of the training history. In the same intake session, also questions about the injury history can be posed. It is also possible that the information of the training history and injury history are provided by a trainer of the user to the system.

When the system has been in use for some time, the training history can be established on the basis of the sensed data which is logged in the log file. Based on the data which is sensed by the mechanical load sensor a mechanical training load can be calculated as follows:

$$\text{Training load}_{mechanical}=\text{number of repetitions of impact}*\text{average magnitude of mechanical parameter}$$

Candidates for the mechanical load parameters are number of steps, distance, rate of pronation, maximal pronation, timing, rate of loading, impact peak, active peak, alignment of joints (such as hip, ankle, knee, foot, elbow, wrist), technique, force, impact, speed, rotation (e.g. tibia during stance), rotational speed (e.g. tibia during stance), leg stiffness, vertical stiffness, torsional stiffness, surface-foot contact time and acceleration. The magnitude of the mechanical parameter is the equivalent for intensity in the mechanical realm. The training load can also be calculated using patterns in the mechanical parameter as an indicator for the intensity of the training.

Based on the training load a value which is indicative for the training history can be determined with e.g. the following formula:

$$\text{Training history}=\text{training load}_{last\ week}*1+\text{training load}_{last\ month}*a+\text{training load}_{last\ three\ months}*b+\text{training load}_{last\ ten\ years}*c$$

Where 1>a>b>c.

A value indicative for the training history can be calculated both for the physiological training load and the mechanical training load. The physiological training history can be established on a similar formula taking into account and giving weight to the physiological training load of the last week, the last month and last three months. The functions of Foster can used for determining a physiological training load. In the description of the background art hereabove Foster has been discussed.

In a second step S2 the injury history is read by the system. A value which is indicative for the injury history can be established as follows. The injury history consists of a list of injury locations for injuries in last ten years (e.g. left knee, right shin). For each injury location, injury history is stored as:

$$\text{Injury history}_{location\ x}=\text{last date with symptoms}_{location\ x}$$

Based on this information an injury relevance can be determined by the following formula:

$$\text{Injury relevance}=\text{training load without injury symptoms at location of minimum(injury history}_{location\ x})/\text{maximum historical training load}$$

Further, a value indicative for injury risk group can be determined:

Risk group injury=

If training history$_{physiological}$<minimal training history value x

OR Rest period after heavy training<minimal extended rest period

Then, risk group$_{physiological}$=high

If training history$_{physiological}$<minimal training history value y

OR Rest period after training<minimal rest period

Then, risk group$_{physiological}$=medium

Else, risk group$_{physiological}$=low

Where x<y

In a third step S3 the maximum heart rate HRmax and the heart rate at rest HRrest are read. This data can be made known to the system through the intake session or can be calculated on the basis of e.g. a rule of thumb which is described hereabove in the description of the background art. As explained earlier, the HRmax can also be measured in the presence of a doctor.

In a fourth step S4 the body mass index is determined on the basis of the formula described hereabove in the description of the background art.

In step S5 a value indicative for the mechanical risk group to which the user belongs is determined:

Risk group$_{biomechanical}$=

If BMI>a BMIthreshold value then risk group$_{biomechanical}$=high

If training history<a minimum training history then risk group$_{biomechanical}$=high If injury relevance<70% then risk group$_{biomechanical}$=high If injury relevance<90% then risk group$_{biomechanical}$=medium Else, risk group$_{biomechanical}$=low.

If BMI is larger than e.g. 28, training schedules should be adapted. The user is recommended to select low impact sports like swimming or cycling.

In step S6 a maximum impact is determined.

Similar to Karvonen, a target biomechanical load can be defined:

$$\text{Target biomechanical load}=((\text{Impact}_{max}-\text{Impact}_{min})\times\%\ \text{Intensity})+\text{Impact}_{min}$$

In contrast with heart rate, Impact$_{max}$ can increase with training. Below, a procedure is given for defining safe increase.

Since Impact in rest is zero, Impact$_{min}$ is defined as the $10^{th}$ percentile lowest impact during a training session.

Maximum impact is based on injury history and is the highest biomechanical intensity at a single point during a training session.

If risk group$_{biomechanical}$=low, then maximum impact=last impact$_{max}$* ((100+growth percentage)/week) *constant*Impact$_{min}$/(Impact$_{max}$−Impact$_{min}$)

The factor Impact$_{min}$/(Impact$_{max}$−Impact$_{min}$) reduces the growth of impact for well trained people since they are already charging their body heavily.

The growth percentage per week could for example be 1%.

If risk group$_{biomechanical}$=medium, then maximum impact=last impact$_{max}$*slow increase percentage* (growth percentage/week)* constant*Impact$_{min}$/(Impact$_{max}$−Impact$_{min}$)

If risk group biomechanical=high, then maximum impact=secure level* last $impact_{before\ injury}$*constant*$Impact_{min}$/($Impact_{max}$−$Impact_{min}$)

The slow increase percentage could be e.g. 50%.

The secure level for biomechanical recovery could be e.g. 50-80%.

In step S7 the mechanical training frequency can be determined on the basis of the following function:

If risk $group_{biomechanical}$=low, then mechanical training frequency=e.g. 3 times a week If risk $group_{biomechanical}$=medium, then mechanical training frequency=e.g. 2 times a week If risk $group_{biomechanical}$=high, then mechanical training frequency=e.g. 1 times a week.

In step S8 a mechanical training load for the next training session is determined using the following function:

If risk $group_{biomechanical}$=low, then mechanical training load=$impact_{average,\ last\ session}$*(growth percentage/week)*constant*$Impact_{min}$/ ($Impact_{max}$−$Impact_{min}$)

The growth percentage per week could for example be 101%.

If risk $group_{biomechanical}$=medium, then mechanical training load=$impact_{average,\ last\ session}$*slow increase percentage*(growth percentage /week)*constant*$Impact_{min}$/($Impact_{max}$−$Impact_{min}$)

If risk $group_{biomechanical}$=high, then mechanical training load=secure level*training $load_{last\ session\ before\ injury}$*constant*$Impact_{min}$/($Impact_{max}$−$Impact_{min}$)

The slow increase percentage could be e.g. 50% and the secure level could be e.g. 50-80%.

Both maximum biomechanical impact and biomechanical training load are monitored for safety. Monotony is decreased by applying a random variation in training duration of e.g. 20% or e.g. 10% in training intensity.

In step S9 a desired heart rate zone is determined. This can be done on the basis of known rules which are e.g. described in references [1], [2], [3], [4] and Karvonen.

In step S10 the physiological frequency, i.e. the number of trainings for a certain forthcoming period, can be determined on the basis of the physiological risk group in which the user is categorized. A similar formula as described above for determining the mechanical training frequency can be used.

In step S11 a physical load for a next training session can be determined based on a similar formula as described in relation to step S8. Physiological growth percentages can be significantly higher than biomechanical growth percentages.

In step S12 a sport is proposed. An advice for a sport selection can be determined by reading the corresponding sport in the underlying table. Within the sport, a more detailed advice based on load and frequency is given.

| | Ph. Low | Ph. Medium | Ph. High |
|---|---|---|---|
| Mech. Low | Walking | Swimming, road cycling, rowing | Swimming, road cycling, rowing |
| Mech. Medium | Yoga | Jogging, stepping, skating | Stepping, skating, field cycling |
| Mech. High | Trampoline, yoga | BMX Biking | Running, soccer, BMX biking, mountain biking |

Based on the mechanical and physiological risk group which have been determined for the user, the system can propose a sport based on the above table. It will be clear that all kinds of different sports can be added in this table.

In step S13 the training variation is determined. A table of trainings is created with physiological training goals (e.g. duration/interval) and mechanical training goals (e.g. maximum impact, sideward impact, specific limbs or joints).

When monotony of the training session increases, the system increases the probability of selecting a training variation with a different characteristic.

A possible function for this is:

$Probability_{training\ variation\ x}$=percentage of training $variation_x$ in training goal/ $frequency_x$ in last month A training variation may also contain suggestions for a sport underground, e.g. asphalt street, grass, gravel, artificial turf, wood soil.

In step S14 a next training session is proposed.

A next training session is suggested using the proposed sport and training variation with a frequency, heart rate zone, physiological load, mechanical load and maximum impact as determined above.

Figure 2:
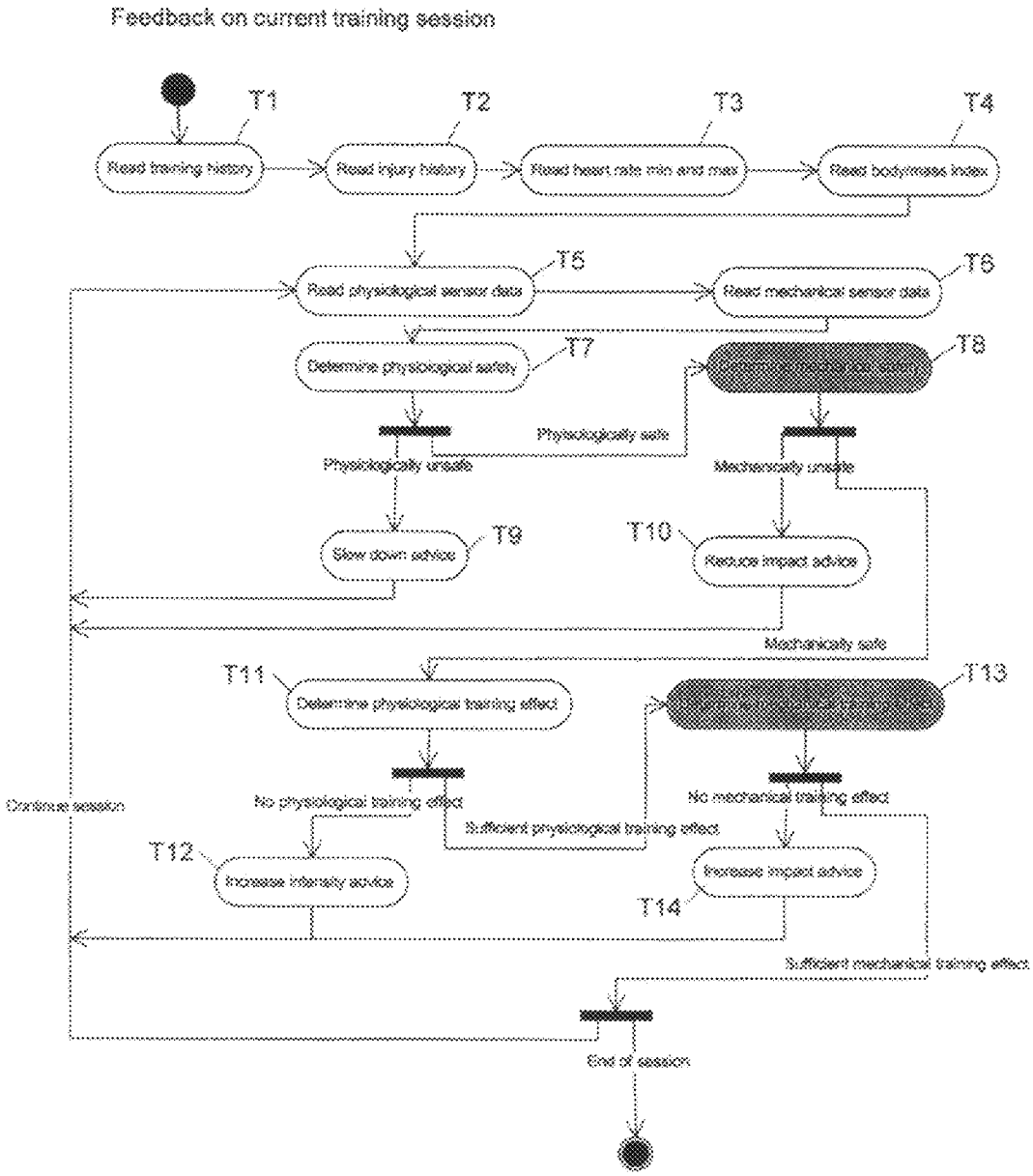
FIG. 2 is a schematic representation of an embodiment for determining an advice on a current training session.

FIG. 2 shows a flow diagram for giving feedback on a current training session. The content of the diagram does not need to be described in detail here because it is clear in itself for the most part. Steps T1-T4 can be determined in the same manner as described hereabove with reference to steps S1-S4.

In T5 the data sensed with the physiological sensor, e.g. the heart beat sensor, is read. In T6 the data sensed with the mechanical sensor, e.g. a vertical acceleration sensor, is read.

From the physiological data read in T5, it is determined in step T7 whether the current session is still physiologically safe. If the current training is still physiologically safe, a mechanical safety is determined in step T8. When the current training session is not physiologically safe, a slow down advice is given in T9.

When the training session is physiologically safe, step T8 is performed. In step T8 the mechanical safety during a current training session can be determined as follows. During a training session, sensors in the system monitor the physiological and mechanical safety of the training session at that very moment. For mechanical safety, maximum impact and total training load are monitored to stay below a maximum level. If the maximum level is surpassed, a warning is given as indicated in step T10.

When the current training session is mechanically safe, in step T11 the physiological training effect is determined, e.g. by measuring the heart beat rate and comparing it whether the actual heart beat is in the desired heart rate zone is. If not the system provides in step T12 a signal to the user to increase the physiological training load, e.g. by indicating to run or cycle faster.

When the physiological training effect is in order, the mechanical training effect is determined in T13. Such mechanical training effect can be determined by comparing the actual training load with a set value. The actual training $load_{mechanical}$ can be determined using the following formula:

Training $load_{mechanical}$=number of repetitions of impact*magnitude of mechanical parameter.

The magnitude of the mechanical parameter during the current session is sensed by the mechanical parameter sensor.

When the training $load_{mechanical}$ is below a set value, the advice is given in step T14 to increase the mechanical impact of the training, e.g. by advising to run on a hard surface instead of a soft surface. When the training $load_{mechanical}$ is within a certain range, the user can continue the training session and the system continues monitoring the user. When the training $load_{mechanical}$ is above a certain set value the advice is given to decrease the mechanical impact of the training or to end the training session dependent on the duration of the training session. The system also checks whether the user has ended the session.

Figure 3:
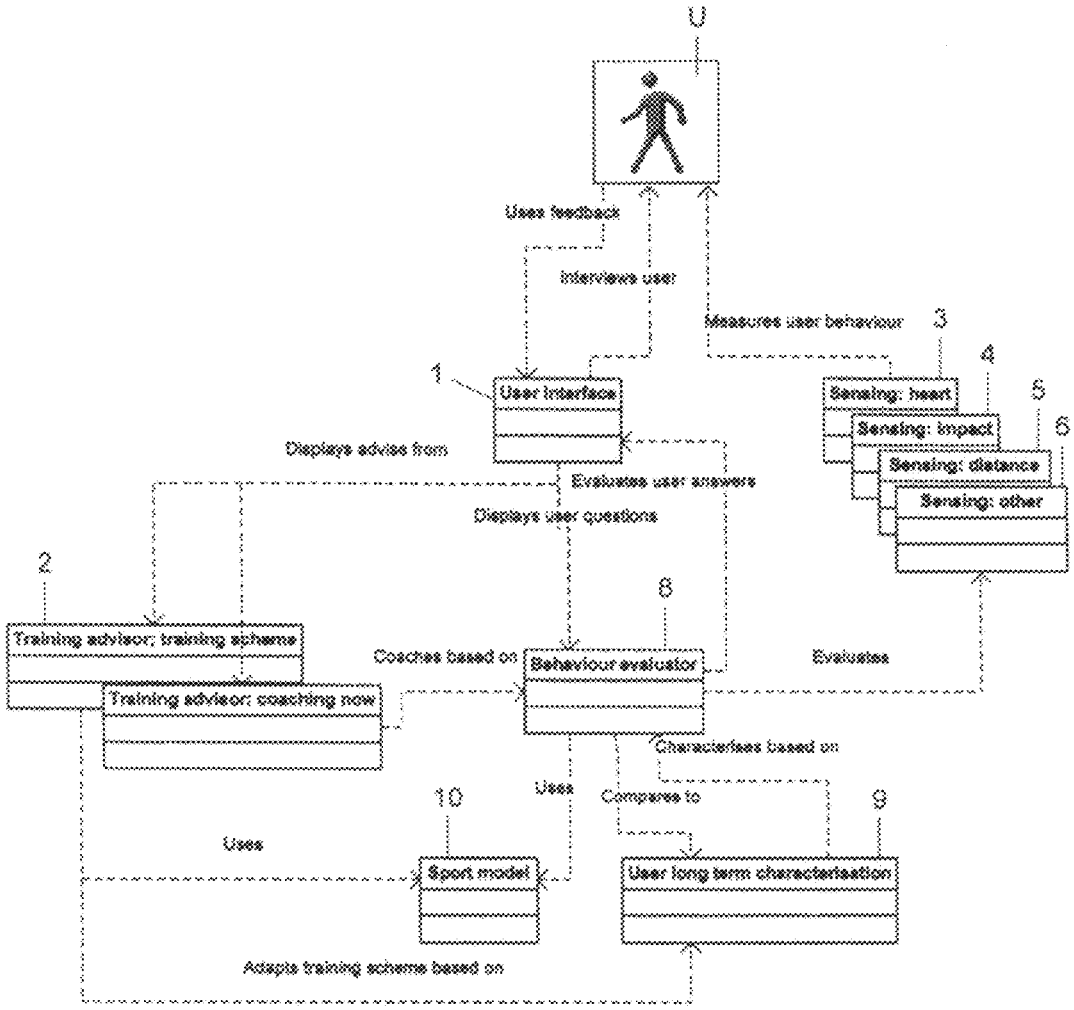
FIG. 3 is a schematic representation of an embodiment of system according to the invention.

FIG. 3 schematically shows the various modules of an exemplary embodiment of the system. U indicates a user. The user U communicates with the system via a user interface 1. The system comprises a training advisor module 2 which can determine a training scheme on the basis the answers given in reply to questions of an interview which displayed on the user interface 1 and based on evaluated sensor data from the Behaviour evaluator 8. The training advisor module 2 also provides advices for a next training session and preferably also about a current training sessions. The advices are provided via the user interface 1.

With reference numbers 3-7 sensors are indicated which sense respectively heart beat rate, impact, distance and other data. Based on this sensed data, a behaviour evaluator module 8 evaluates the condition and behaviour of the user. This evaluation data can be provided to the user interface 1 for informing the user U. From this evaluation, a long term user characterisation is determined in module 9. This long term user characterisation comprises data about the mechanical risk group and physiological risk group in which the user U is characterized. The long term characterisation of the user U is used by the training advisor module 2 for determining the training scheme, the next training advice and for determining the current training advice. The training advice module 2 also uses a sport model 10, e.g. the table described above, for categorizing different sports to determine the training scheme, the next training advice and the current training advice. The sport model 10 is also used by the behaviour evaluator 8 to evaluate the behaviour of the user.

In an another embodiment of the system according to the invention the least one sensor for measuring a mechanical parameter is a sensor for determining acceleration of, for example, hip, ankle or knee, wherein the training advice module is arranged for scheduling a training session to be chosen from at least two of the following categories:

a high impact type, e.g. running on a hard surface,
a moderate impact type, e.g. jogging on a soft surface, or
a low impact type, e.g. bicycling, walking or swimming.

Figure 4:
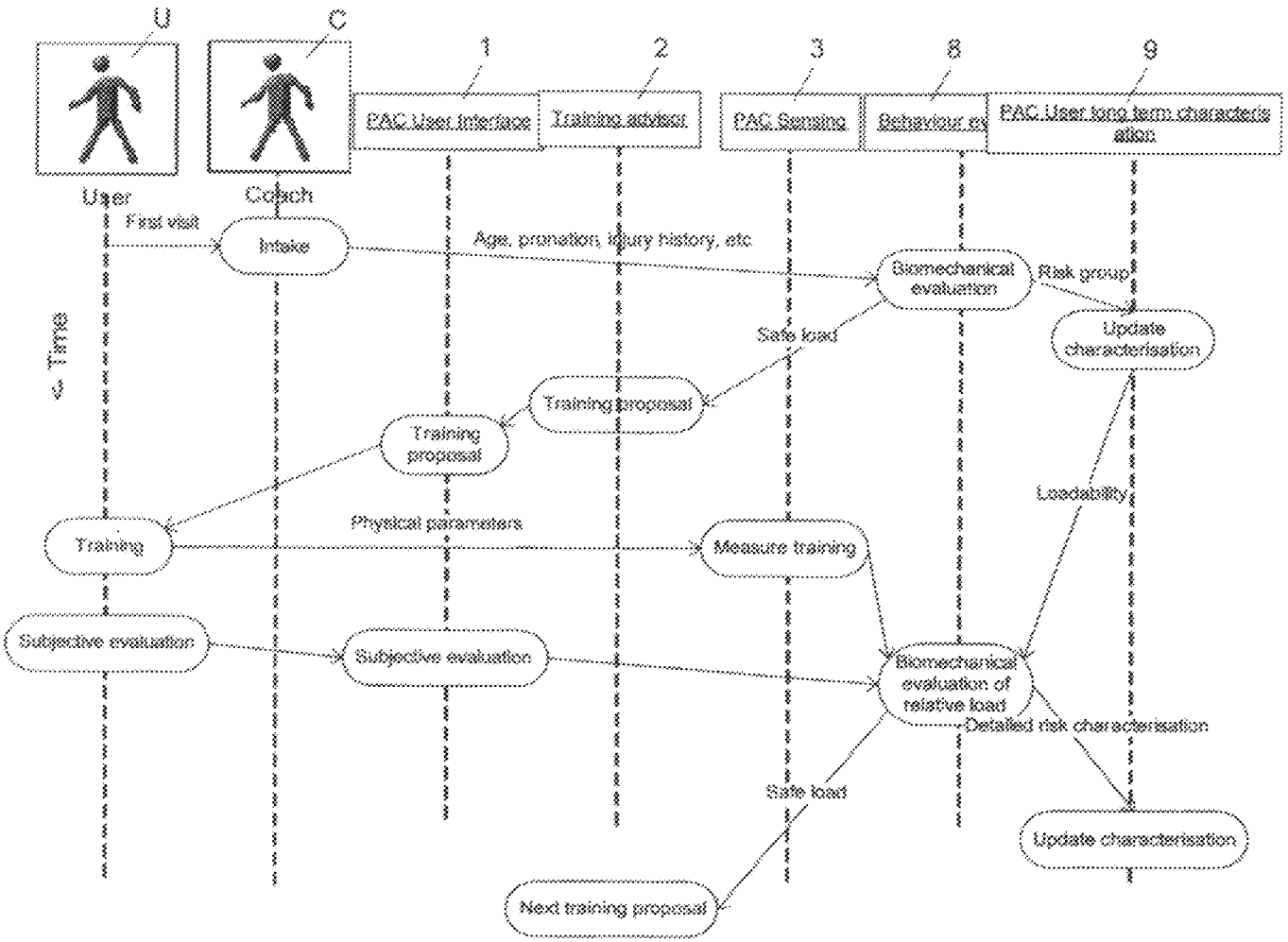
FIG. 4 shows a time/step-diagram with which the use of an embodiment of the system is elucidated.

FIG. 4 shows a step time diagram of the various steps to be taken to determine a training proposal.

U indicates the user;
C indicates a coach
1 indicates the user interface;
2 indicates the training advisor module;
3 indicates the various sensors;
8 indicates the behaviour evaluator module;
9 indicates the long term user characterisation module;
12 indicates a facility in which a first intake can be performed. This could be e.g. at home or in a fitness centre. In the diagram time runs from the top to the bottom of the figure.

The arrows indicate the order of the steps. Further elucidation of the figure does not seem necessary.

Figure 5:
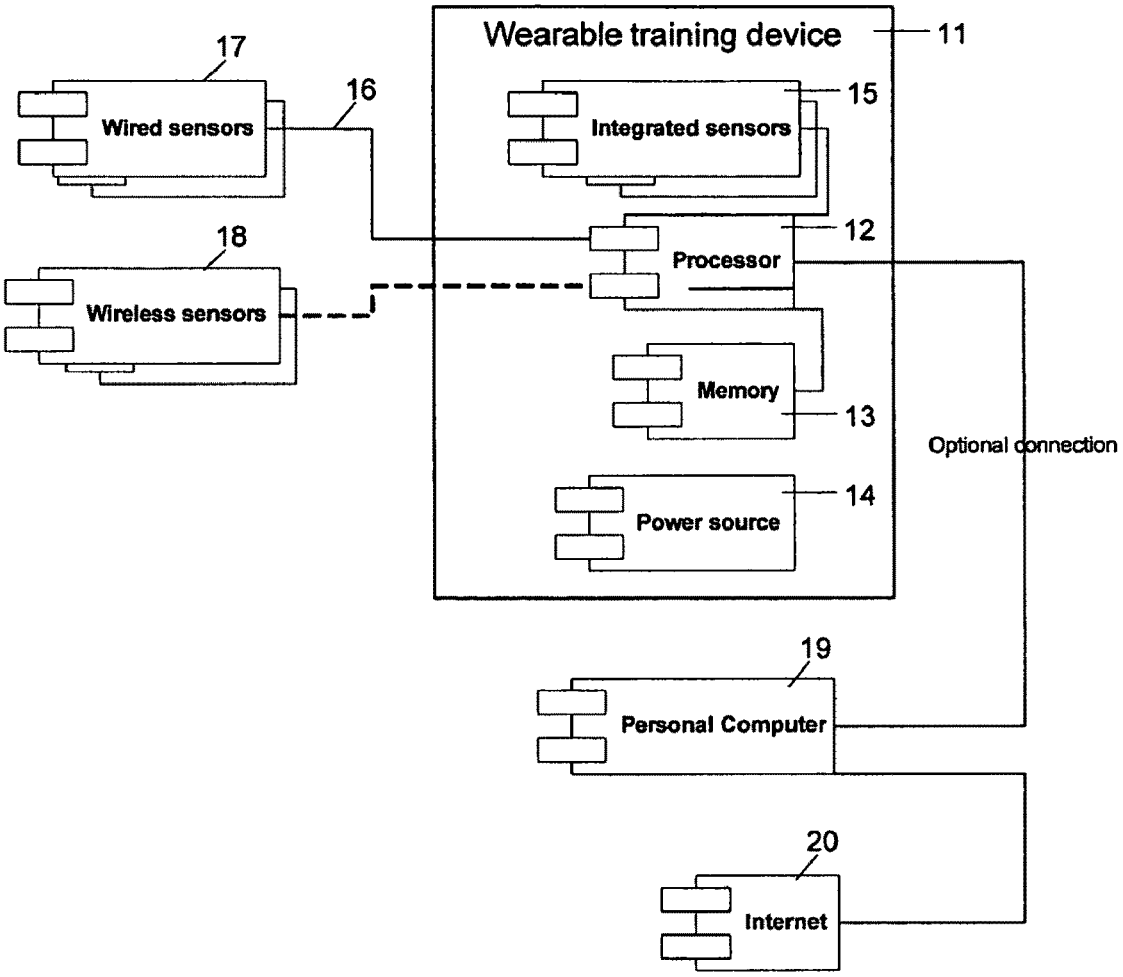
FIG. 5 is a schematic diagram of an embodiment of the system.

FIG. 5 shows an embodiment of a system according to the invention. A housing 11 includes a processor 12, a memory 13, a power source 14 and integrated sensors 15. Via wiring 16 wired sensors 17 are connected with the processor 12. Also wireless sensors 18 communicate with the processor 12. It is clear that a system having only integrated, wired or wireless sensors or combinations of two of those types of sensors also fall within the scope of the present invention. Optionally the device can be connected to a personal computer 19. Of course, the personal computer can be linked to the internet 20. The data logged in the log file can be processed in the processor 12 or in the personal computer 19 or in a external computer which is part of the internet 20.

It will be clear that the invention is not limited to the described embodiments but is defined by the appended claims.

REFERENCES

1. Londeree B R, Moeschberger M L. Influence of age and other factors on maximal heart rate. J Cardiac Rehab 1984; 4:44-49. 'maximal heart rate (HRmax) may be predicted from age using any of several published equations'
2. Morree de J J, Jongert M W A, Poel van der G., Inspanningsfysiologie, oefentherapie en training. Bohn Stafleu van Loghum, Houten, 2006, Chapter 4: Hartfunctie, circulatie en inspanning, pages 60-67
3. American Journal of respiratory and critical care medicine 2003; 167(2):211-277
4. ACSM 2006; Msse 1992; 24(10):1173-1179—Whaley et al. (=220−1 ft)

The invention claimed is:

1. A programmed processor-based system for optimizing training, the system comprising:

at least one sensor for measuring a mechanical load parameter which is indicative of a mechanical load of the training, the mechanical load parameter being taken from the group consisting of:
number of steps,
distance,
rate of pronation,
maximal pronation,
timing,
rate of loading,
impact peak,
active peak,
alignment of joints,
technique,
force,
impact,
speed,
rotation,
rotation speed,
leg stiffness,
vertical stiffness,
torsional stiffness,
floor-foot contact time,and
acceleration;

a storage module for storing data which are dispatched by the least one sensor in a log file;

a training advice module which is arranged for determining a personal training advice related to a load assessment of the user based on at least data stored in the log file; and at least one output device for outputting said training advice to said user, wherein the training advice module is configured to base the training advice on a mechanical load assessment of the user based on a cumulative mechanical load parameter that is indicative of the mechanical load history of the training sessions which occurred before the training session to be determined, the training advice comprising a type of training to be performed in a next training session so that:

when the cumulative mechanical load parameter or mechanical load history is high in a load range, the training advice module schedules a training, session having a relatively low mechanical load, thereby promoting recovery of the user, and when the cumulative mechanical load parameter is low in the load range, the training advice module schedules a training session having a relatively high mechanical load, thereby stimulating expanding biomechanical loadability of the user through supercompensation.

2. The programmed processor-based system according to claim 1, wherein the data stored in the log file is also used for determining a training advice for a current training session.

3. The programmed processor-based system according to claim 1, the system comprising at least one sensor for measuring a physiological parameter, the storage module for storing data also being adapted to store data which are dispatched by the at least one sensor for measuring a physiological parameter.

4. The programmed processor-based system according to claim 3, wherein the physiological parameter is chosen from the group consisting of:

heart beat rate,
respiration rate,
skin temperature,
core body temperature,
volume of oxygen uptake ($VO_2$),
respiratory ratio between oxygen and carbon dioxide (RER), and
lactate levels.

5. The programmed processor-based system according to claim 1, wherein the system comprises at least one sensor for measuring a performance parameter chosen from the group consisting of:

speed,
distance,
acceleration,
height,
impact (e.g. of hit),
precision,
reproducibility,
gross efficiency,
goals,
correct passes,
successful interventions,
successful assists, and
number of goal shots.

6. The programmed processor-based system according to claim 1, wherein the system comprises at least one sensor for measuring an environmental parameter chosen from the group consisting of:

environmental temperature, humidity, air pressure,
altitude,
global position,
wind speed,
wind direction,
water temperature,
wave speed,
wave direction,
wave size,
ground/ice/snow temperature,
ground/ice/snow density, and
ground/ice/snow stiffness.

7. The programmed processor-based system according to claim 1, wherein the training advice module processes historical sensor data stored in the log file and, based thereon, determines the training frequency.

8. The programmed processor-based system according to claim 1, wherein the training advice module processes historical sensor data stored in the log file and, based thereon, determines the type of training to be performed in the next or current training session.

9. The programmed processor-based system according to claim 1, wherein the training advice module, when processing sensor data stored in the log file for determining a training advice, is adapted to take into account at least one of the following parameters:

age,
length,
weight,
gender,
training level of the user of the system,
dominant sport,
training goals, and
subjective training evaluation indicators based on filled in question forms.

10. The programmed processor-based system according to claim 1, wherein at least one sensor for measuring a mechanical parameter is a sensor for determining acceleration of a body part wherein the training advice module is arranged for scheduling a training session to be chosen from at least two of the following categories:

a high impact type,
a moderate impact type, or
a low impact type.

11. The programmed processor-based system according to claim 1, comprising a representation module for representing the data in the log file in a graphical manner on a display or a hard copy.

12. The programmed processor-based system according to claim 1, wherein a display and the storage module are part of an electronic device, the electronic device chosen from the group comprising: a computer, a hand held computer, a mobile phone, and a watch, and wherein the sensors are connectable to, or are part of the electronic device.

13. The programmed processor-based system according to claim 12, wherein the sensors are connectable to the electronic device via a wireless connection.

14. The programmed processor-based system according to claim 12, wherein the training advice module is part of said electronic device.

15. The programmed processor-based system according to claim 12, wherein the training advice module is separate from a server at a remote site, wherein the log file in the storage module is transferable to the server via a data network.

16. The programmed processor-based system according to claim 13, wherein the training advice module is separate from a server at a remote site, wherein the log file in the storage module is transferable to the server via a data network.

17. The programmed processor-based system according to claim 13, wherein the training advice module is part of said electronic device.

* * * * *